US008845308B2

(12) United States Patent
Tetzlaff et al.

(10) Patent No.: US 8,845,308 B2
(45) Date of Patent: Sep. 30, 2014

(54) ELECTRIC SUBMERSIBLE PUMP (ESP) THRUST MODULE WITH ENHANCED LUBRICATION AND TEMPERATURE DISSIPATION

(75) Inventors: Steven K. Tetzlaff, Owasso, OK (US); Chad A. Craig, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 341 days.

(21) Appl. No.: 13/086,503

(22) Filed: Apr. 14, 2011

(65) Prior Publication Data

US 2012/0263610 A1 Oct. 18, 2012

(51) Int. Cl.
*F04D 13/10* (2006.01)
*F04D 29/047* (2006.01)
*F04D 29/58* (2006.01)

(52) U.S. Cl.
CPC ..... *F04D 29/0476* (2013.01); *F04D 13/10* (2013.01); *F04D 29/588* (2013.01)
USPC ..... 417/423.3; 417/423.11; 417/423.12; 417/423.13

(58) Field of Classification Search
USPC ..... 417/423.3, 423.11, 423.12, 423.13; 277/431, 432, 512, 515
See application file for complete search history.

(56) References Cited

U.S. PATENT DOCUMENTS

| | | | | |
|---|---|---|---|---|
| 6,183,208 | B1 * | 2/2001 | Qandil et al. | 417/201 |
| 6,602,059 | B1 * | 8/2003 | Howell et al. | 417/423.3 |
| 7,841,395 | B2 | 11/2010 | Gay et al. | |
| 2008/0078560 | A1 * | 4/2008 | Hall | 166/387 |
| 2009/0183879 | A1 * | 7/2009 | Cox | 166/302 |
| 2010/0078177 | A1 | 4/2010 | Parmeter et al. | |
| 2010/0202896 | A1 | 8/2010 | Du et al. | |

* cited by examiner

*Primary Examiner* — Charles Freay
*Assistant Examiner* — Philip Stimpert
(74) *Attorney, Agent, or Firm* — Bracewell & Giuliani LLP

(57) ABSTRACT

A thrust module and a seal module for use in an electric submersible pump assembly is provided. The thrust module provides increased lubrication and heat dissipation while increasing sealing redundancies within the module. The thrust module includes a thrust bearing that absorbs thrust from the primary pump. A circulation pump assembly is coupled to the thrust bearing to circulate fluid through the thrust bearing and dissipate heat generated in the thrust bearing through a plurality of fins formed on an exterior surface of the circulation pump assembly. The seal module has labyrinth discs positioned within the seal module that inhibit fluid flow through the seal module. The seal module also includes check valves that release fluid from and allow fluid into the seal module at predetermined pressures. The sealing assembly is interposed between the thrust bearing and a primary pump of the electric submersible pump.

19 Claims, 9 Drawing Sheets

ELECTRIC SUBMERSIBLE PUMP (ESP) THRUST MODULE WITH ENHANCED LUBRICATION AND TEMPERATURE DISSIPATION

BACKGROUND OF THE INVENTION

1. Field of the Invention

This invention relates in general to electric submersible pumps (ESPs) and, in particular, to an ESP thrust module with enhanced lubrication and temperature dissipation.

2. Brief Description of Related Art

Electric submersible pump (ESP) assemblies are disposed within wellbores and operate immersed in wellbore fluids. These wellbore fluids may be corrosive or toxic and were they to penetrate the electric motor portion of the ESP, would cause failure of the electric motor and thus the ESP. Thus, ESPs include sealing assemblies interposed between the electric motor and the pump portion of the ESP. These sealing assemblies prevent the flow or seepage of wellbore fluids into the electric motor. However, present sealing assemblies provide only limited sealing between the pump and the electric motor. If the primary seals fail, then the sealing assemblies and subsequently the electric motor will be inundated with wellbore fluids. Therefore, there is a need for an improved sealing assembly that provides additional redundancy.

The sealing assemblies also may include thrust bearings adapted to transfer the thrust generated by the pump in the opposite direction of the flow of wellbore fluids. Lubricating fluid is often interposed within the thrust bearings to allow a thrust runner coupled to an axial shaft within the thrust bearing to rotate relative to bearings supporting the axle. Operation of the thrust bearing generally cause this fluid to break down and wear over time. This is due in part to heat generated between the thrust runner and thrust bearing that causes a loss in viscosity of the lubricating fluid. The problem becomes exacerbated when the ESP is operated in subsurface/subsea wellbores. In these locations, the ESP can be subject to extremely high downhole temperatures. The high temperatures speed up the process of lubricating fluid breakdown. When the lubricating fluid breaks down, it may inhibit and even prevent operation of the thrust bearing, significantly decreasing the efficiency and life of the ESP. Therefore, there is a need for improved lubrication of thrust bearings within an ESP.

SUMMARY OF THE INVENTION

These and other problems are generally solved or circumvented, and technical advantages are generally achieved, by preferred embodiments of the present invention that provide an ESP thrust module with enhanced lubrication and temperature dissipation.

In accordance with an embodiment of the present invention, a submersible pump assembly is disclosed. The submersible pump assembly includes a rotary primary pump, a motor operationally coupled to the primary pump for driving the pump, a thrust bearing in a thrust bearing chamber, and a sealing assembly. The thrust bearing chamber is interposed between the motor and the primary pump and absorbs thrust from the primary pump. The seal assembly is coupled to the thrust bearing and further coupled to the primary pump. A circulation pump resides in the thrust bearing chamber and is in fluid communication with the thrust bearing to circulate fluid through the thrust bearing. A cooling chamber having a plurality of fins formed on an exterior portion of the cooling chamber is coupled to the thrust bearing chamber. The cooling chamber dissipates heat generated in the thrust bearing. The circulation pump is in fluid communication with the cooling chamber to circulate fluid from the thrust bearing through the cooling chamber.

In accordance with another embodiment of the present invention, a submersible pump assembly is disclosed. The submersible pump assembly includes a rotary primary pump, a motor operationally coupled to the primary pump for driving the pump, and a thrust bearing. The thrust bearing resides in a thrust bearing chamber between the motor and the primary pump. The thrust bearing absorbs thrust from the primary pump. A circulation pump in the thrust bearing chamber is in fluid communication with the thrust bearing to circulate fluid through the thrust bearing. A heat exchange housing defining a cooling chamber forms a portion of the thrust bearing chamber. The heat exchange housing has a plurality of fins formed on an exterior portion of the to dissipate heat generated in the thrust bearing, and the circulation pump is in fluid communication with the cooling chamber to circulate fluid from the thrust bearing through the cooling chamber. The submersible pump assembly includes a rotating shaft passing through a center of the heat exchange housing that is rotated in response to operation of the motor; the rotating shaft couples to and rotates the circulating pump.

In accordance with yet another embodiment of the present invention, a submersible pump assembly is disclosed. The submersible pump assembly includes a rotary primary pump, a motor operationally coupled to the primary pump for driving the pump, and a sealing chamber housing coupled between the motor and the primary pump. A sealing chamber rotating shaft is supported within the sealing chamber housing and driven by the motor. The assembly also includes a plurality of labyrinth discs mounted in sealing engagement with but non-rotating engagement with the sealing chamber rotating shaft. Each labyrinth disc has a periphery that seals to the sealing chamber housing and further seals to the sealing chamber rotating shaft, thereby dividing the sealing chamber housing into chambers between each labyrinth disc. The submersible pump assembly includes at least one well fluid inlet in the sealing chamber housing. At least two check valves allow fluid flow into the sealing chamber housing, and at least two check valves permit fluid flow out of the sealing chamber housing. The check valves are positioned within the sealing chamber housing so that fluid may flow into and out of the sealing chamber housing at a predetermined pressure. The labyrinth discs also contain ports extending from an area proximate to the sealing chamber housing on a first surface to an area proximate to the sealing chamber rotating shaft on a second surface. The ports provide a tortuous fluid flow path for well fluid through the labyrinth discs to inhibit fluid flow through the sealing chamber assembly.

An advantage of a preferred embodiment is that it provides a thrust bearing with improved performance and service life. This is accomplished through the disclosed embodiments that increase lubrication fluid flow through the thrust bearing during operation of the thrust bearing. In addition, improved thrust bearing performance and service life may be accomplished through the disclosed embodiments that increase the rate of heat transfer from the thrust bearing to the surrounding environment, thereby maintaining optimal operating conditions for the lubrication fluid of the thrust bearing. Furthermore, improved thrust bearing performance and service life may be accomplished through the disclosed embodiments that provide an improved sealing apparatus to maintain the isolation of the thrust bearing and the lubricating fluid from the wellbore fluids pumped to the surface by an ESP.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning ESP operation, construction, and the like have been omitted inasmuch as such details are not considered necessary to obtain a complete understanding of the present invention, and are considered to be within the skills of persons skilled in the relevant art.

Figure 1:
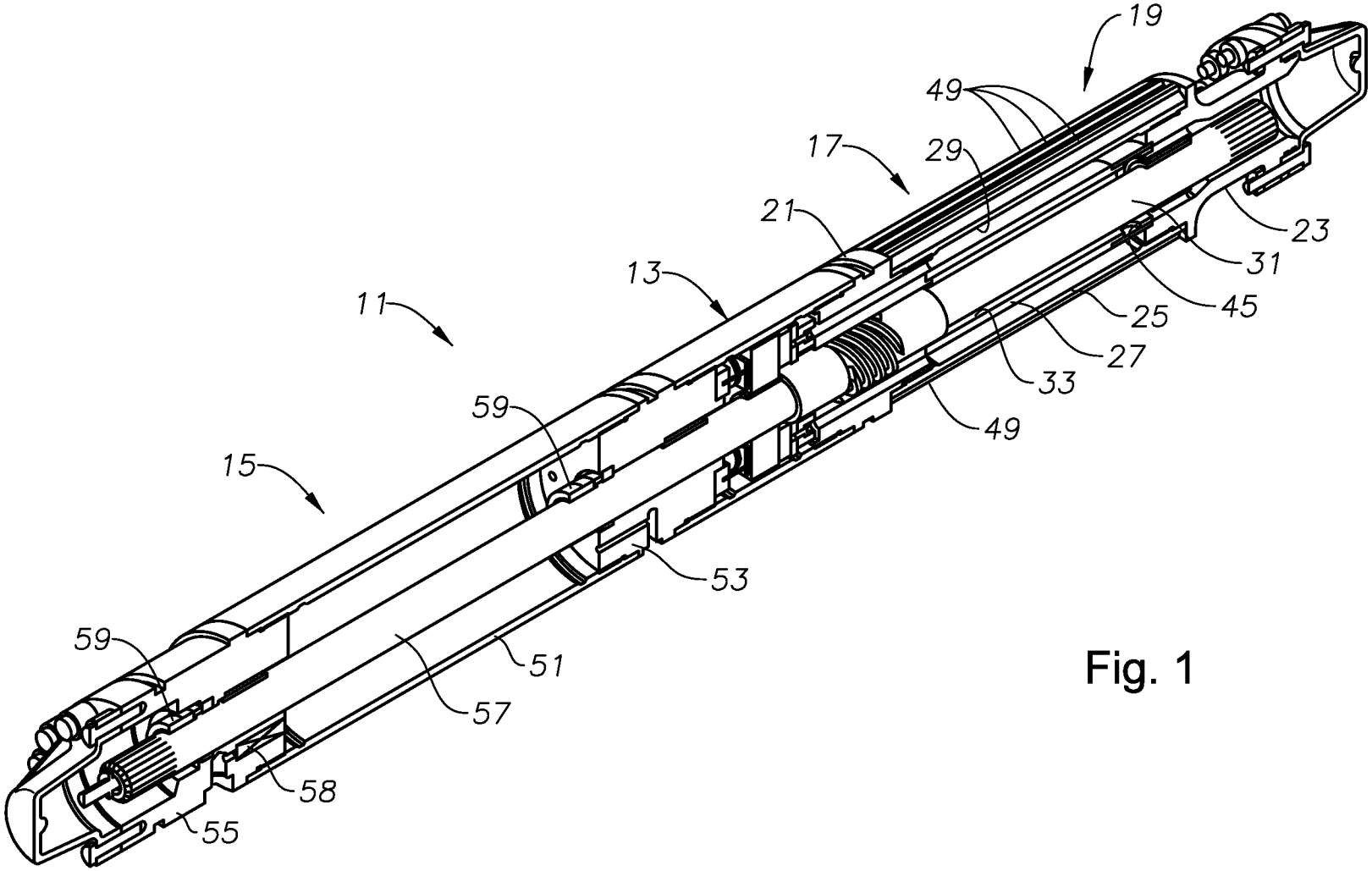
FIG. 1 is a sectional perspective view of a thrust bearing module in accordance with an embodiment of the present invention.

Referring to FIG. 1, thrust module assembly 11 includes a thrust bearing assembly 13, a sealing chamber assembly 15, and a cooling chamber assembly 17. Cooling chamber assembly 17 includes a heat exchanger assembly 19, and a guide assembly 21.

Figure 2:
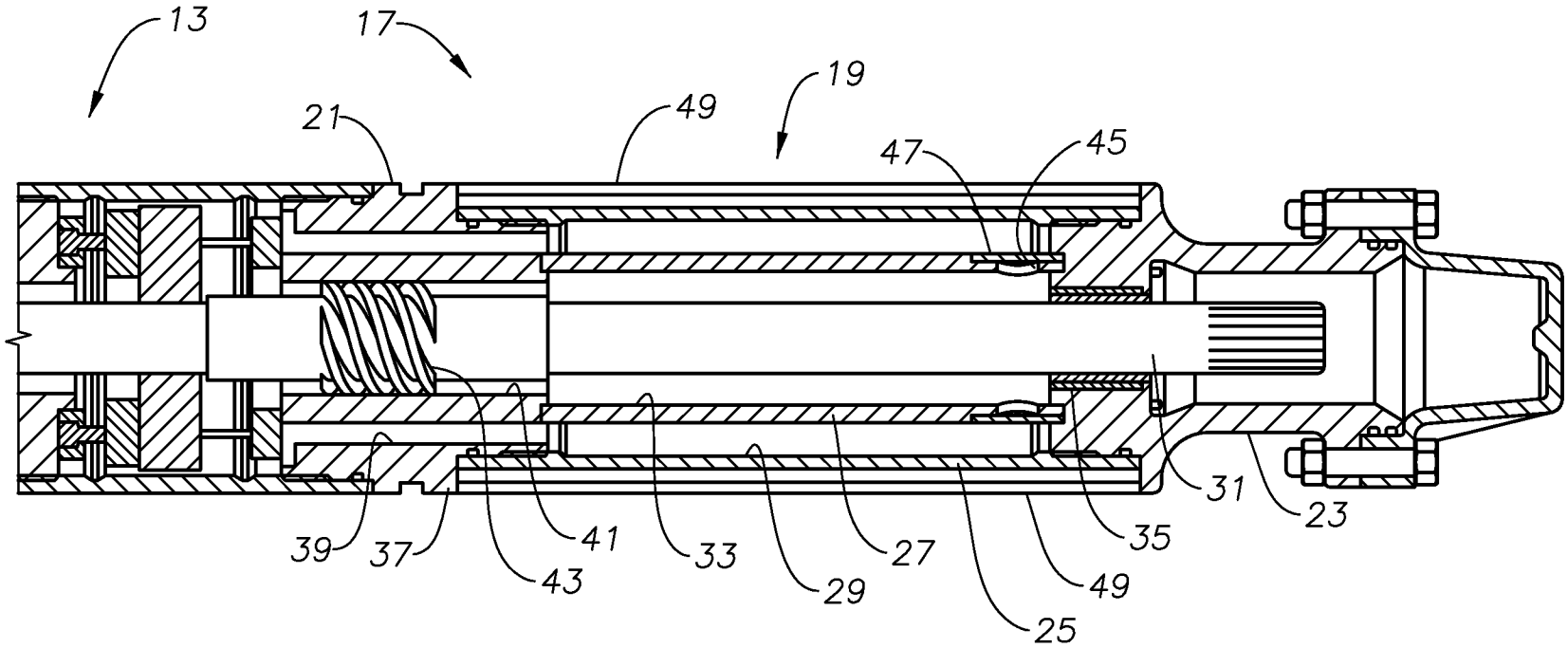
FIG. 2 is a sectional view of a cooling chamber of the thrust bearing module of FIG. 1.

Referring to FIG. 2, heat exchanger assembly 19 forms one end of cooling chamber assembly 17 and includes a cooling chamber base 23, a heat exchange housing 25, and an interior housing 27. Heat exchange housing 25 and interior housing 27 are tubular members with interior housing 27 having a smaller diameter than heat exchange housing 25 such that when interior housing 27 is inserted into heat exchange housing 25 and mounted to cooling chamber base 23, an annular fluid reservoir chamber 29 will be formed. A cooling chamber shaft 31 passes through cooling chamber base 23 and inner diameter housing 27 to form an annular flow passage 33 between cooling chamber shaft 31 and interior housing 27. Interior housing 27 includes openings 45 proximate to cooling chamber base 23. Openings 45 pass through a wall of interior housing 27, thereby allowing flow of fluid from fluid reservoir 29 into fluid flow passage 33. In the illustrated embodiment, filters 47 are mounted over openings 45 to prevent the passage of particles larger than a predetermined size from fluid reservoir 29 into fluid flow passage 33. Filters 47 are positioned so that fluid flow will cause filters 47 to maintain their position over openings 45. A person skilled in the art will understand that any suitable means to secure filters 47 over openings 45 are contemplated and included in the disclosed embodiments. In the illustrated embodiment, filters 47 may be plated metal filter elements. A person skilled in the art will understand that the filters 47 may comprise wrapped screen or other unspecified filter media designed to prevent flow of particulates from fluid reservoir 29 into flow passage 33. Cooling chamber shaft 31 is supported by a bearing 35 within cooling chamber base 23 and has a splined end for coupling to additional equipment.

Guide assembly 21 mounts to heat exchanger assembly 19 opposite cooling chamber base 23. Guide assembly 21 includes a pump housing 37 that mounts to heat exchange housing 25 and interior housing 27. Pump housing 37 defines a plurality of tubular flow passages 39 positioned to allow flow of fluid from an area proximate to thrust bearing assembly 13 into fluid reservoir chamber 29. Pump housing 37 further defines a pump chamber 41. Pump chamber 41 is coaxial with annular flow passage 33. In the illustrated embodiment, guide assembly 21 includes a guide vane type pump 43 mounted to cooling chamber shaft 31 within pump chamber 41. The pitch of pump 43 is selected based on the fluid viscosity and the resonance time necessary to maximize the heat transfer from the circulating fluid to heat exchange housing 25 within fluid reservoir 29.

Referring to FIG. 1, heat exchange housing 25 includes a plurality of fins 49 formed on an exterior diameter portion of heat exchange housing 25. Fins 49 run the length of heat exchange housing 25 and conduct heat from fluid reservoir 29 through a wall of heat exchange housing 25 into the environment surrounding cooling chamber assembly 17. In the illustrated embodiment, fins 49 are of a number, size, and shape such that fins 49 double the exterior diameter surface area of heat exchange housing 25 over a heat exchange housing 25 without fins 45. In the illustrated embodiment, the exterior diameter surface of each fin 49 coincides with the exterior diameter of thrust bearing module 11. Thus, a significant increase of the surface area of cooling chamber housing 25 is accomplished without an increase in the outer diameter of the thrust assembly when compared to current thrust bearing modules and assemblies. A person skilled in the art will understand that the number size and shape of fins 49 may be varied to accommodate the particular application of cooling chamber assembly 17.

Figure 3A:
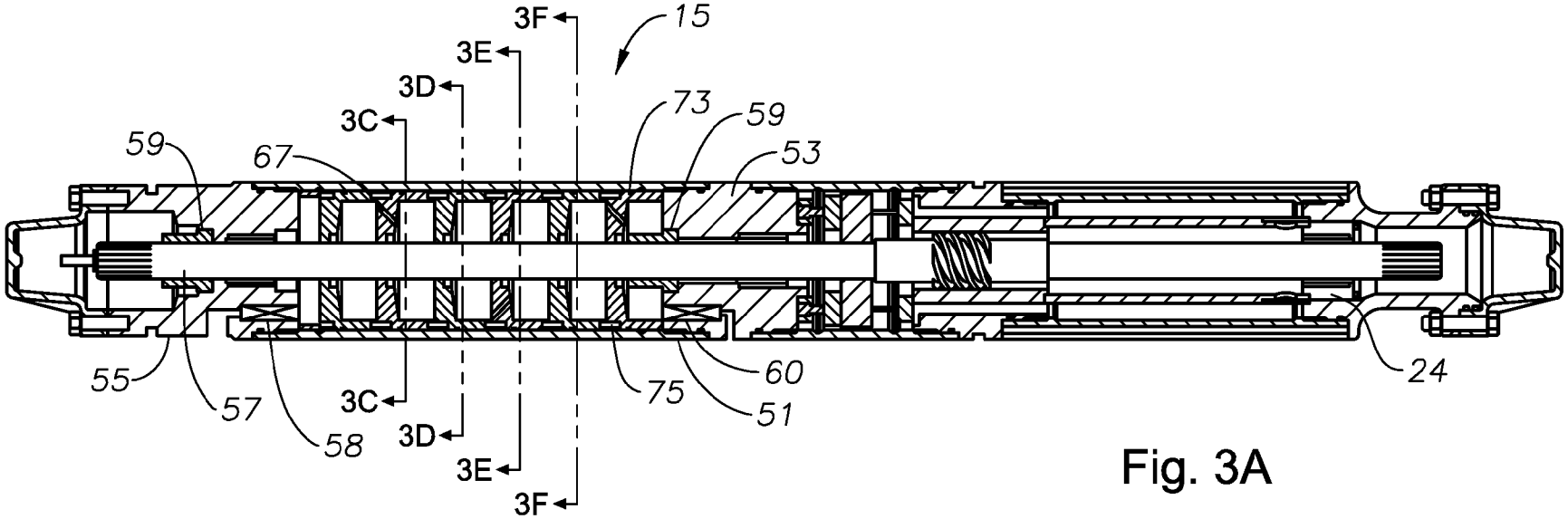
FIG. 3A is a sectional view of an alternative embodiment of a sealing chamber assembly in accordance with an embodiment of the present invention.
Figure 5:
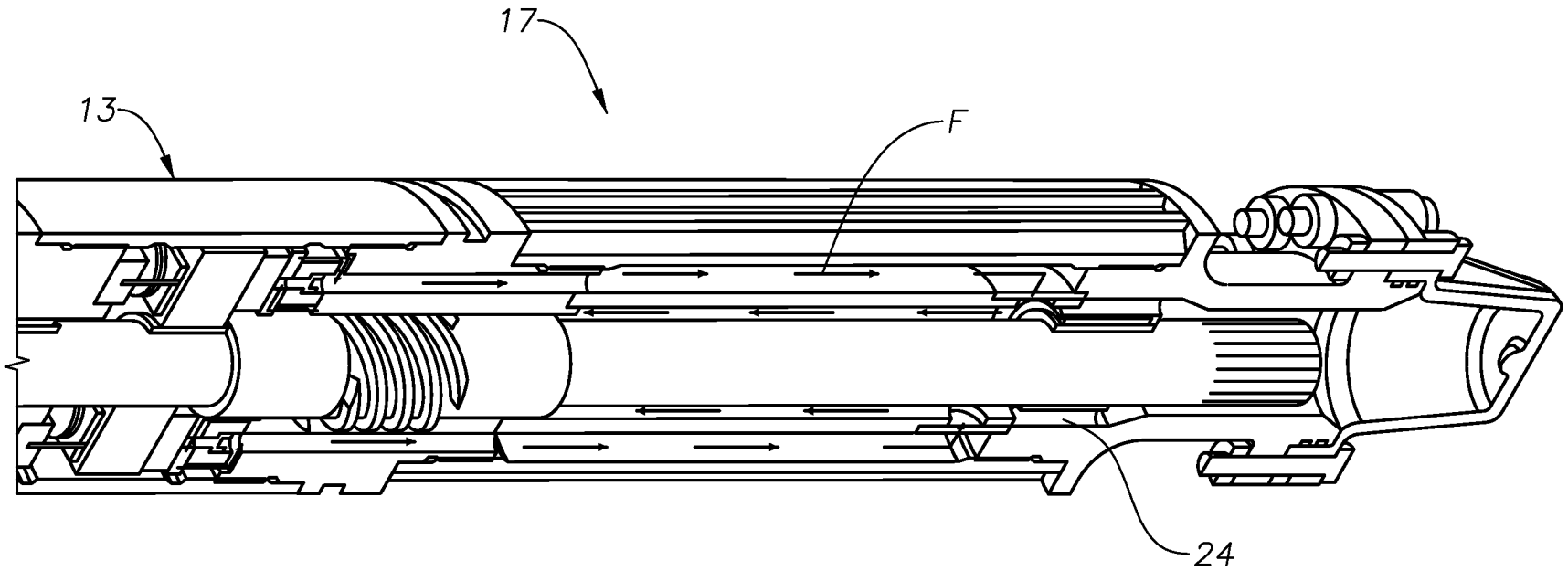
FIG. 5 is a sectional perspective view of the cooling chamber assembly and thrust bearing of FIG. 1 illustrating a fluid flow path through the cooling chamber assembly and the thrust bearing.

In operation of cooling chamber assembly 17, cooling chamber shaft 31 rotates in response to rotation of an ESP pump motor (not shown). Rotation of cooling chamber shaft 31 causes pump 43 to rotate. As pump 43 rotates it will draw fluid from fluid passageway 33 through pump chamber 41 and then through thrust bearing assembly 13 as illustrated by flow path F in FIG. 5. In turn, fluid within thrust bearing assembly 13 will be forced through flow passages 39 into fluid reservoir 29, and fluid within fluid reservoir 29 will circulate across filters 47 through openings 45 into flow passage 33. As fluid flows through thrust bearing assembly 13, heat generated through operation of thrust bearing assembly 13, described in more detail below, will transfer into the fluid, thereby heating the fluid. This fluid will then flow into fluid reservoir 29 where the heat will transfer from the fluid into heat exchange housing 25. The heat is then conducted by heat exchange housing 25 through fins 49 and into the ambient environment. A person skilled in the art will understand that lubricating fluid within cooling chamber assembly 17 may communicate with lubricating fluid within an electric motor 91 coupled to cooling chamber base 23. As shown in FIG. 3A and FIG. 5, cooling chamber base 23 may include flow passages 24 permitting such fluid communication. In this manner, cooling chamber assembly 17 may aid in both cooling of and debris removal from electric motor 91.

Referring to FIG. 1, sealing chamber assembly 15 includes a chamber housing 51. Chamber housing 51 includes a first end 53 secured to thrust bearing 13, and a second end 55 adapted to couple sealing chamber assembly 15 to an external device such as a pump, pump intake, or another sealing chamber assembly 15. A sealing chamber shaft 57 is supported within sealing chamber assembly 15 at first end 53 and second end 55. Sealing chamber shaft 57 may rotate and may have an end coupled to cooling chamber shaft 31 of cooling chamber assembly 17 such that rotation of shaft 57 will cause rotation of shaft 31, and rotation of shaft 31 will cause rotation of shaft 57. Rotational shaft seals 59 allow shaft 57 to rotate within sealing chamber assembly 15, while preventing wellbore fluids from passing along shaft 57 to the subsequent pump element, such as the electric motor. Incorporating a second rotational shaft seal 59 proximate to thrust bearing assembly 13, as shown herein, provides additional redundancy within sealing chamber assembly 15. This provides a decrease in the instances of contamination between wellbore fluid outside thrust bearing module 11 and thrust bearing assembly 13 and the electric motor (not shown) providing mechanical energy to the system, while also inhibiting migration of lubricating fluid in thrust bearing assembly 13 out of thrust bearing assembly 13.

Figure 3B:
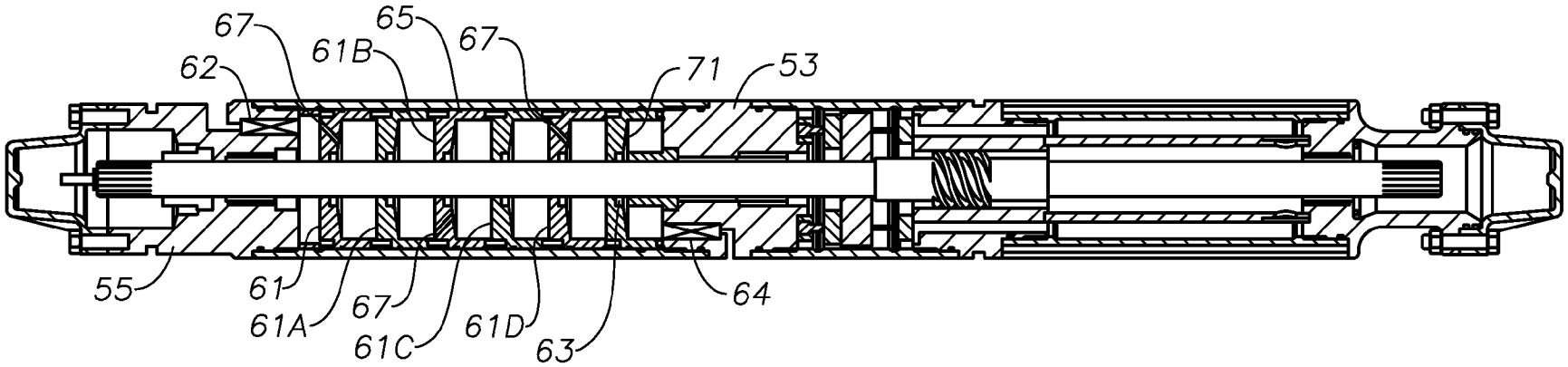
FIG. 3B is a sectional view of the alternative embodiment of the sealing chamber assembly of FIG. 3A taken through a plane perpendicular to the section of 3A as shown by line 3B-3B of FIG. 3D.

As shown in FIG. 3A and FIG. 3B, sealing chamber assembly 15 includes first, second, third, and fourth check valves 58, 60, 62, and 64, respectively. First and third check valves 58, 62 reside within head 55 of sealing chamber assembly 15. Second and fourth check valves 60, 64 reside within first end of sealing chamber assembly 53. Third and fourth check valves 62, 64 are offset 90 degrees from the positions of first and second check valves 58, 60. First and fourth check valves 58, 64 are configured to allow fluid flow into sealing chamber assembly 15 from the wellbore, and second and third check valves 60, 62 are configured to allow fluid flow into the wellbore from sealing chamber assembly 15. In the illustrated embodiment, second and third check valves 60, 62 will open when pressure within sealing chamber assembly 15 reaches a predetermined maximum pressure, such as 50 p.s.i., thereby allowing lubricating fluid within sealing chamber assembly 15 to flow out of sealing chamber assembly 15. Similarly, first and fourth check valves 58, 64 will open when pressure within sealing chamber assembly 15 reaches a predetermined minimum pressure, thereby allowing wellbore fluid to flow into sealing chamber assembly 15. In this manner, check valves 58, 60, 62, 64 will prevent catastrophic failure of thrust module assembly 11 by both preventing over pressurization and under pressurization of thrust module assembly 11, both of which could lead to catastrophic failure of the components of thrust module assembly 11.

Figure 3C:
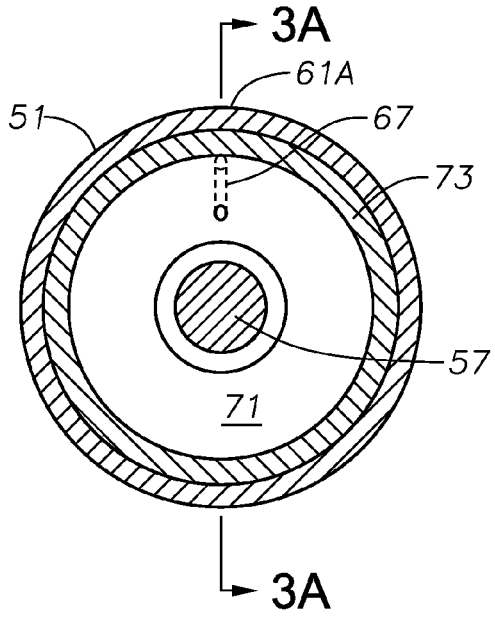
FIG. 3C-3F are sectional views of the sealing chamber of FIG. 3A illustrating clocking of vent passages of FIG. 3A.
Figure 3D:
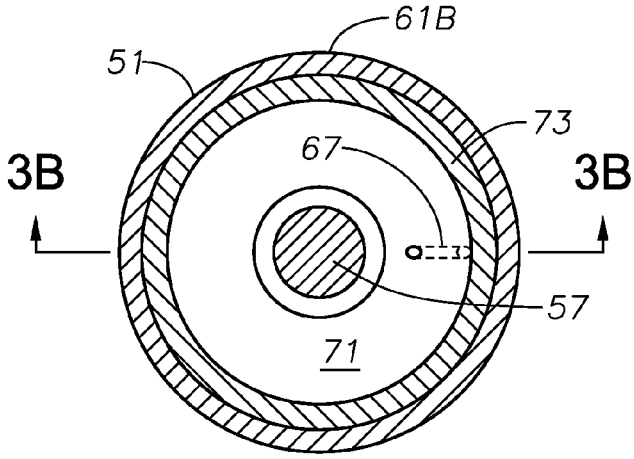
Figure 3E:
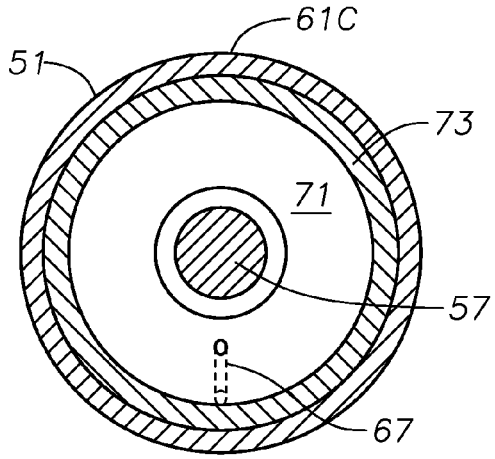
Figure 3F:
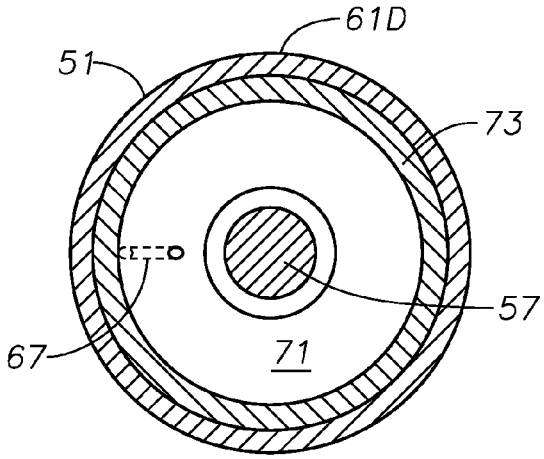
Figure 3I:
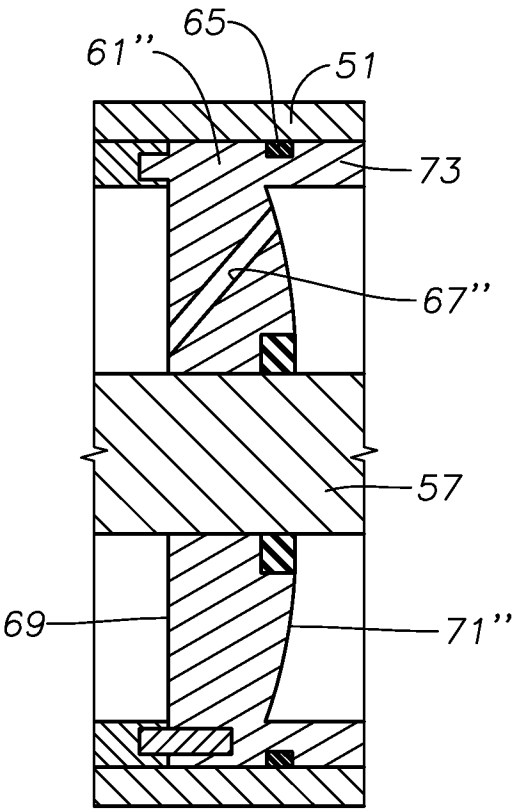
FIG. 3G-3I are sectional views of alternative components of the sealing chamber of FIG. 3A.

As illustrated in FIG. 3A, sealing chamber assembly 15 can include a plurality of labyrinth discs 61. Each labyrinth disc 61 mounts within sealing chamber housing 51 and seals to sealing chamber housing 51 and sealing chamber shaft 57. Labyrinth discs 61 seal to sealing chamber shaft 57 with lip seals 63. An exterior diameter portion of each labyrinth disc 61 seals to sealing chamber housing 51 with a labyrinth o-ring 65. Labyrinth discs 61 do not rotate in response to rotation of sealing chamber shaft 57. Each labyrinth disc 61 also includes a vent passage 67 extending between a first surface 69 of each labyrinth disc 61 to a second surface 71 of each labyrinth disc 61. In the illustrated embodiment, vent passages 67 extend from an area of labyrinth disc 61 proximate to sealing chamber shaft 57 to an area proximate to sealing chamber housing 51. Vent passages 67 may be straight as shown, or include a plurality of turns as shown in FIG. 3G. In the illustrated embodiment, second surface 71 is concaved to facilitate removal of air within sealing chamber assembly 15 during manufacture of sealing chamber assembly 15.

Vent passage 67 comprises a fluid flow path through each labyrinth disc 61. Vent passage 67 allows for some movement of fluid across each labyrinth disc 61 while making the flow passage across the labyrinth disc as arduous as possible. This allows some movement of fluid to equalize pressures in the varying chambers created by multiple labyrinth discs 61 within sealing chamber housing 51 while inhibiting movement of lubrication fluid within thrust bearing assembly 13 out of the assembly into the wellbore. This also inhibits movement of wellbore fluids into thrust bearing assembly 13 and the electric motor (not shown) by forcing the wellbore fluids migrating into seal chamber assembly 15 through check valves 58, 60, 62, and 64 through a tortuous flow path. A blocking fluid having a density heavier than the expected density of the wellbore fluids may be used within sealing chamber assembly 15 to further inhibit movement of wellbore fluids.

Each labyrinth disc 61 also includes an annular protrusion or cylindrical wall 73 on an exterior diameter portion of labyrinth disc 61. Annular protrusion 73 locates each labyrinth disc 61 coaxial with sealing chamber shaft 57 and provides a spacing element between the adjacent labyrinth disc 61. At an end of each annular protrusion 73 distal from second surface 71, annular protrusion 73 is bored at four locations spaced equidistant around annular protrusion 73. Each bore is adapted to receive a pin 75. Each pin 75 mounts within one bore in annular protrusion 73 and further mounts within a corresponding bore defined within surface 69 of each labyrinth disc 61. Pin 75 prevents rotation of each labyrinth disc 61 relative to the adjacent labyrinth disc 61, helping to maintain each labyrinth disc 61 stationary within sealing chamber housing 51. In addition, each pin 75 maintains the corresponding labyrinth disc 61 in the proper orientation relative to the adjacent labyrinth discs 61 as described in more detail below.

Each labyrinth disc 61 includes one vent passage 67. During manufacture of sealing chamber assembly 15 each labyrinth disc 61 is rotated or "clocked" relative to the adjacent labyrinth disc 61 to misalign vent passages 67. This causes each vent passage 67 to be oriented 90 degrees from the vent passages 67 in the adjacent labyrinth discs 61. As shown in FIGS. 3C through 3F, adjacent labyrinth discs 61A, 61B, 61C, and 61D each have a vent passage 67 and an annular protrusion 73. Referring to FIG. 3C, vent passage 67 of labyrinth disc 61A is at the twelve o'clock position as shown in FIG. 3C. The next adjacent labyrinth disc 61B has a vent passage 67 at the three o'clock position as shown in FIG. 3D. The labyrinth disc 61 adjacent to labyrinth disc 61B is labyrinth disc 61C. Vent passage 67 of labyrinth disc 61C occupies the six o'clock position as shown in FIG. 3E. Labyrinth disc 61D, adjacent to labyrinth disc 61C has a vent passage 67 located at the nine o'clock position as shown in FIG. 3F. Subsequent labyrinth discs 61 will continue to have vent passages 67 clocked ninety degrees from the previous vent passage 67.

By clocking each vent passage 67 relative to the adjacent vent passages 67, the tortuousness of the fluid flow path across each labyrinth disc 61 is increased. This will further inhibit movement of wellbore fluid from an area external to thrust bearing module 11 and the associated electric motor (not shown) to an area internal to thrust bearing module 11. Similarly, this will inhibit movement of lubricating fluid from an area internal to thrust bearing module 11 to an area external to thrust bearing module 11. A person skilled in the art will understand that alternative embodiments may clock each labyrinth disc 61 at an angle greater than or less than ninety degrees.

Referring to FIG. 3A, sealing chamber assembly 15 may be assembled horizontally or vertically, then pressure tested and filled with fluid. A blocking fluid may then be pumped into sealing chamber assembly 15. In the embodiment illustrated in FIG. 3A, when vertically assembled, air trapped between each labyrinth disc 61 will migrate to the apex of concave profile 71. There the air may escape from vent passages 67. When placed horizontally in operation, wellbore fluid may migrate into sealing chamber housing 51 as described above. By clocking each vent passage, as described with respect to FIGS. 3B through 3E, the wellbore fluid that migrated into sealing chamber housing 51 will be blocked by labyrinth discs 61 and unable to find a direct path through sealing chamber assembly 15. Instead, the wellbore fluid must traverse a tortuous flow path through the misaligned vent passages 67; thus, decreasing instances of contamination of the lubricating fluid in thrust bearing 13. This will help to decrease the rate of lubricating fluid deterioration. Similarly, lubricating fluid in thrust bearing 13 that migrates out of thrust bearing 13 into sealing chamber assembly 15 will be inhibited from free flowing from thrust bearing 13. Vent passages 67 will aid in keeping the pressure within sealing chamber assembly 15 and thrust bearing module 11 uniform throughout the module.

Referring to FIG. 3G, in an alternative embodiment of labyrinth disc 61, vent passage 67' extends between first surface 69 and second surface 71 of labyrinth disc 61 as described above with respect to FIG. 3A. Vent passage 67' defines a fluid flow path through labyrinth disc 61 that requires the fluid to make at least two turns as it flows from the second surface 71 to the first surface 69.

Figure 3H:
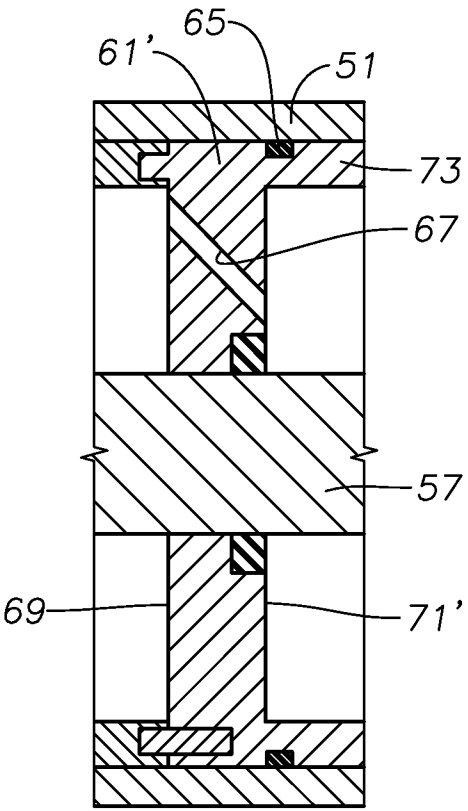
Figure 3G:
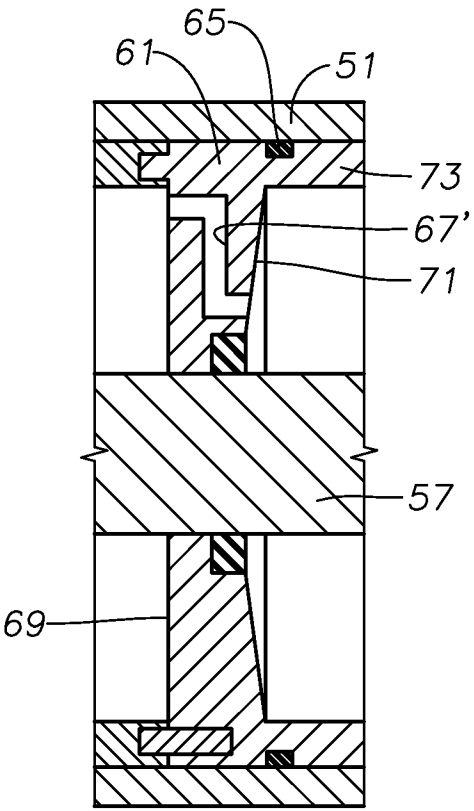

Referring to FIG. 3H, in another embodiment of labyrinth disc 61, labyrinth disc 61' includes the elements of labyrinth disc 61 of FIG. 3A. In the alternative embodiment, second surface 71' is perpendicular to cooling chamber shaft 57. Referring to FIG. 3I, in yet another embodiment of labyrinth disc 61, labyrinth disc 61" includes the elements of labyrinth disc 61 of FIG. 3A. In the alternative embodiment, second surface 71" is convex, again facilitating removal of air during manufacture. Vent passage 67" may be oriented to extend from second surface 71" proximate to annular protrusion 73 to first surface 69 proximate to sealing chamber shaft 57. In each alternative embodiment, labyrinth discs 61 may be clocked as described above with respect to FIGS. 3C-3F.

Figure 4:
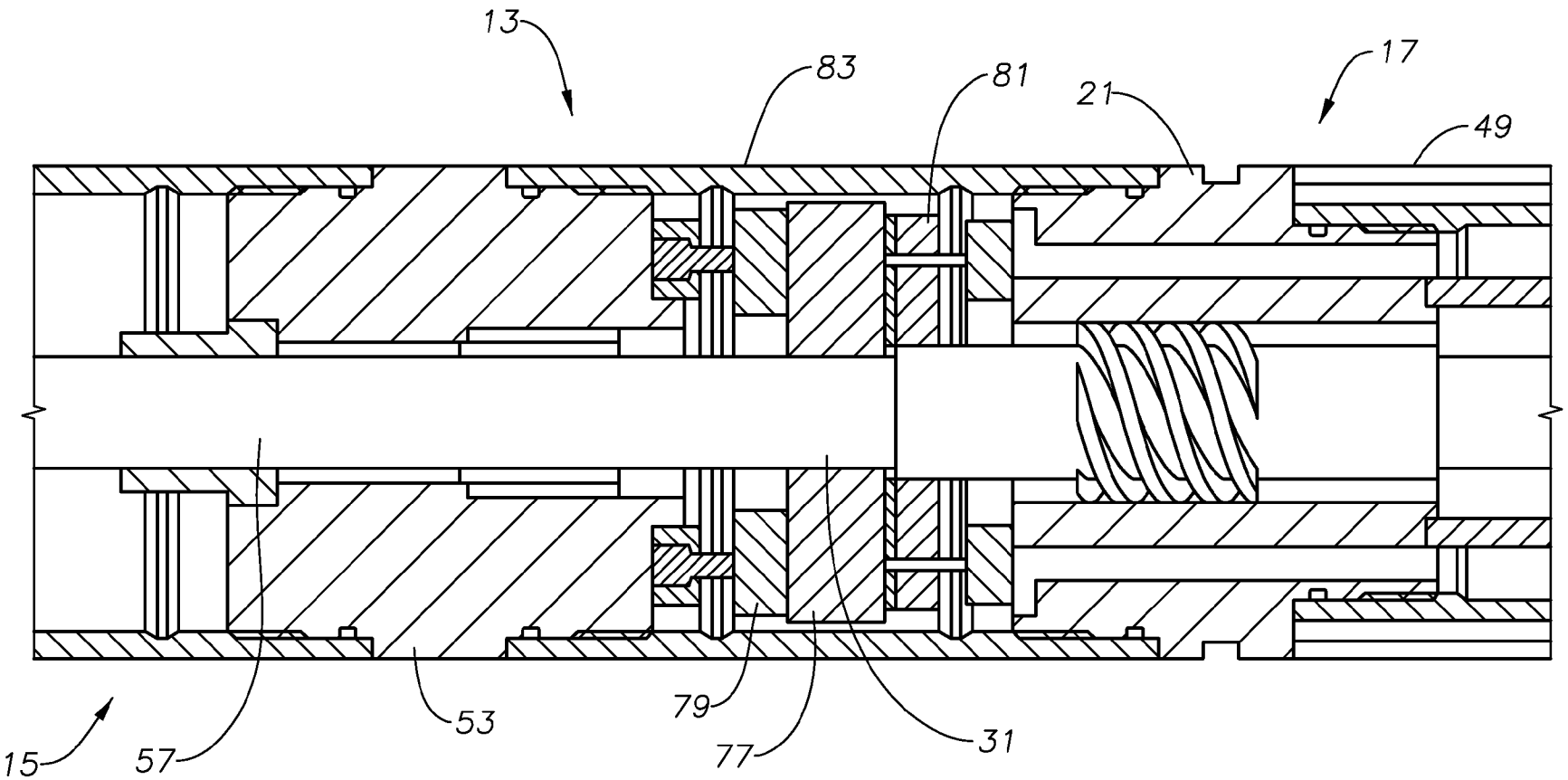
FIG. 4 is a sectional view of the thrust bearing of FIG. 1.

Referring to FIG. 4, there is shown thrust bearing assembly 13 assembled to sealing chamber assembly 15 and cooling chamber assembly 17. Thrust bearing assembly 13 includes a thrust runner 77, up thrust bearings 79, and primary thrust bearings 81. Thrust runner 77 mounts to cooling chamber shaft 31 such that as cooling chamber shaft 31 rotates, thrust runner 77 will rotate within a thrust housing 83 coupling pump housing 21 to first end 53 of sealing chamber assembly 15. Thrust runner 77 has an exterior diameter slightly smaller than the inner diameter of thrust housing 83, such that fluid may flow between the exterior diameter surfaces of thrust runner 77 and the interior diameter surface of thrust housing 83. During operation, thrust generated by an electric submersible pump (not shown) will force thrust runner 77 against primary bearings 81 as cooling chamber shaft 31 rotates. Fluid circulated by pump 43 will wedge between the interfacing surfaces of thrust runner 77 and primary bearings 81, lubricating the bearing surfaces and absorbing the heat generated by the frictional forces between thrust runner 77 and primary bearings 81.

During operation of thrust bearing module 11, rotating shaft seal 59 proximate to sealing chamber end 53 will seal sealing chamber shaft 57; thus, preventing migration of lubricating fluid in thrust bearing assembly 13 into sealing chamber assembly 15. Similarly, rotating shaft seal 59 proximate to sealing chamber end 55 will seal sealing chamber shaft 57; thus, preventing migration of wellbore fluid outside of thrust bearing assembly 11 into sealing chamber assembly 15. However, pressure differences between the operating components, such as the thrust bearing assembly 13 and the sealing chamber assembly 15 may cause lubricating fluid in thrust bearing assembly 13 to migrate past rotating shaft seal 59 into sealing chamber assembly 15. Similarly, pressure differences between the operating environment and the sealing chamber assembly 15 may cause migration of wellbore fluid past rotating shaft seal 59 into sealing chamber assembly 15.

Additionally, lubricating fluid and wellbore fluid may migrate past or leak past check valves 58, 60, 62, 64 into sealing chamber assembly 15. Still further, pressurization issues, such as extreme over pressurization or under pressurization may cause check valves 58, 60, 62, 64 to open allowing flow into sealing chamber assembly 15 or out of sealing chamber assembly 15. Any wellbore fluid or lubricating fluid that migrates into sealing chamber assembly 15 will comingle with a high temperature blocking fluid filling areas between each labyrinth disc 61. Labyrinth discs 61 will allow fluid flow only through vent passages 67. The "clocking" of the vent passages will necessitate that any fluids that migrate into sealing chamber assembly 15 will be unable to flow directly from end 55 to end 53 and vice versa. Instead the flow must move through vent passages 67 first at an upper end then, off to a side and so on. In addition, because vent passages 67 do not pass through labyrinth discs 61 parallel to rotating shaft 57, fluid migrated into sealing chamber assembly 15 will have increased difficulty traversing across each labyrinth disc. Thus, labyrinth discs 61 will limit the amount of intermingling or contamination of lubricating fluid in thrust bearing 13 and cooling chamber assembly 17 caused by pressurization issues within thrust bearing module 11.

Figure 6:
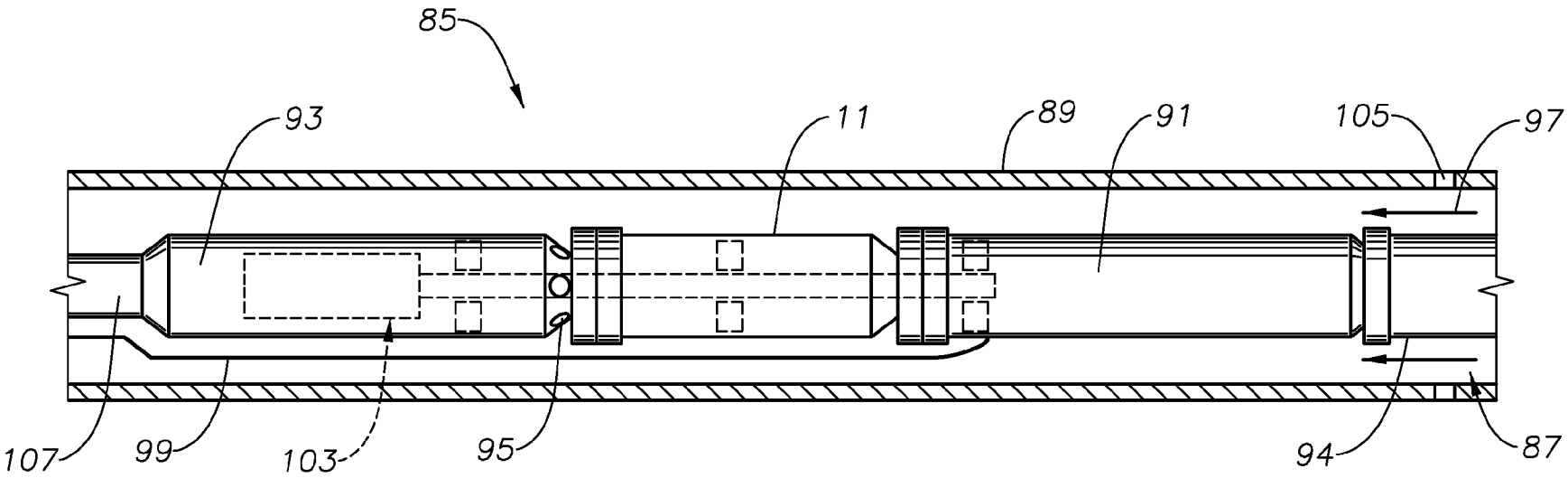
FIG. 6 is a sectional view of an electric submersible pump assembly incorporating the thrust bearing module of FIG. 1.

With reference now to FIG. 6, an example of an electrical submersible pumping (ESP) system 85 is shown in a side partial sectional view. ESP 85 is disposed in a wellbore 87 that is lined with casing 89. In the embodiment shown, ESP 85 comprises a motor 91, a thrust module 11 attached to an uphole end of the motor 91, and a pump 93 above thrust module 11. Fluid inlets 95 shown on the outer housing of pump 93 provide an inlet for wellbore fluid 97 in wellbore 87 to enter into pump section 93. A gas separator (not shown) could be mounted between thrust module 11 and pump section 93. A pressure equalizer 94, such as a metal bellows, may be mounted below the motor to reduce a pressure differential between lubricant in the motor and wellbore fluid 97. In the illustrated embodiment, ESP 85 is in a horizontal placement within wellbore 87. A person skilled in the will understand that ESP 85 may also be in a vertical placement within wellbore 87.

In an example of operation, pump motor 91 is energized via a power cable 99 and rotates an attached shaft assembly 101 (shown in dashed outline). Although shaft 101 is illustrated as a single member, it should be pointed out that shaft 101 may include cooling chamber shaft 31 and sealing chamber shaft 57 of FIG. 1. As shown in FIG. 6, shaft assembly 101 extends from motor 91 through thrust module 11 to pump section 93. Impellers 103 (also shown in dashed outline) within pump section 93 are coupled to an upper end of shaft 101 and rotate in response to shaft 101 rotation. Impellers 103 comprise a vertical stack of individual members alternatingly interspaced between static diffusers (not shown). Wellbore fluid 97, which may include liquid hydrocarbon, gas hydrocarbon, and/or water, enters wellbore 87 through perforations 105 formed through casing 89. Wellbore fluid 97 is drawn into pump 93 from inlets 95 and is pressurized as rotating impellers 103 urge wellbore fluid 97 through a helical labyrinth upward through pump 93. The pressurized fluid is directed to the surface via production tubing 107 attached to the upper end of pump 93. As impellers 103 urge wellbore fluid 97 upward impellers 103 generate a thrust in the opposite direction that is reacted to by thrust runner 77 of FIG. 1 and FIG. 5.

Figure 7:
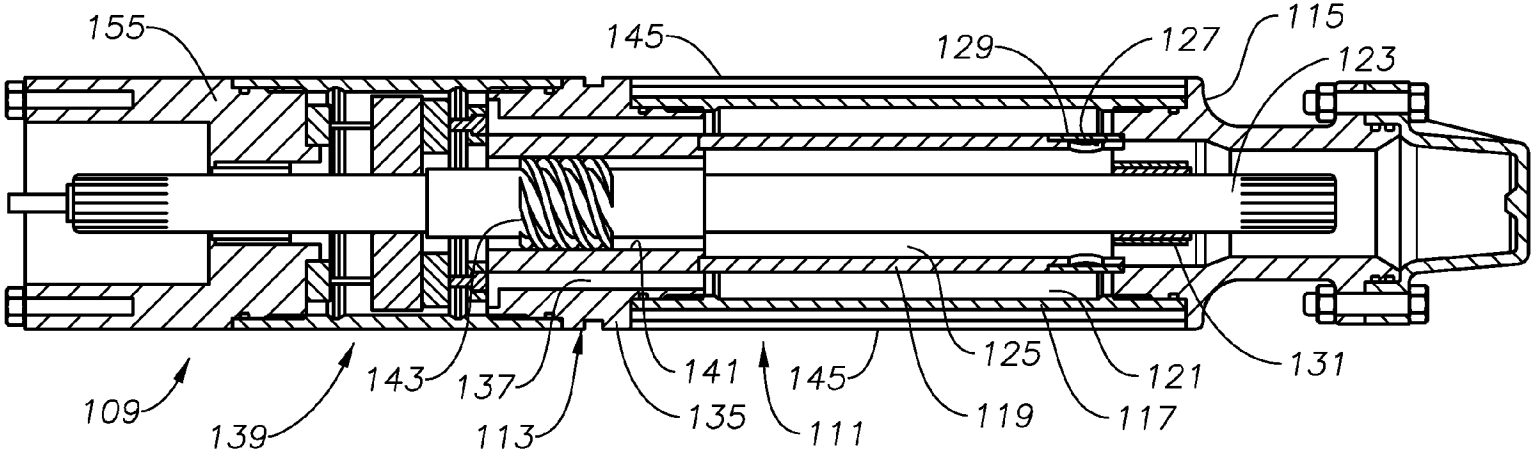
FIG. 7 is a thrust bearing lubrication module in accordance with an embodiment of the present invention.

Embodiments of the present invention may comprise only cooling chamber assembly 17. As shown in FIG. 7, a cooling chamber assembly 109 includes a heat exchanger assembly 111, and a guide assembly 113. Heat exchanger assembly 111 forms one end of cooling chamber assembly 109 and includes a cooling chamber base 115, a heat exchange housing 117, and an interior housing 119. Heat exchange housing 117 and interior housing 119 are tubular members with interior housing 119 having a smaller diameter than heat exchange housing 117 such that when interior housing 119 is inserted into heat exchange housing 117 and mounted to cooling chamber base 115, an annular fluid reservoir chamber 121 will be formed between heat exchange housing 117 and interior housing 119. A cooling chamber shaft 123 passes through cooling chamber base 115 and inner diameter housing 119 to form an annular flow passage 125. Interior housing 119 includes openings 127 proximate to cooling chamber base 115. Openings 127 pass through a wall of interior housing 119, thereby allowing flow of fluid from fluid reservoir 121 into fluid flow passage 125. In the illustrated embodiment, filters 129 are mounted over openings 127 to prevent the passage of particles larger than a predetermined size from fluid reservoir 121 into fluid flow passage 125. In the illustrated embodiment, filters 129 may be plated metal filter elements. A person skilled in the art will understand that the filters 129 may comprise wrapped screen or other unspecified filter media designed to prevent flow of particulates from fluid reservoir 121 into flow passage 125. Cooling chamber shaft 123 is supported by a bearing 131 within cooling chamber base 115 and has a splined end for coupling to additional equipment.

Guide assembly 113 mounts to heat exchanger assembly 111 opposite cooling chamber base 115. Guide assembly 113 includes a pump housing 135 that mounts to heat exchange housing 117 and interior housing 119. Pump housing 135 defines an annular flow passage 137 positioned to allow flow of fluid from an area proximate to a thrust bearing assembly 139 into fluid reservoir chamber 121. Pump housing 135 further defines a pump chamber 141. Pump chamber 141 is coaxial with annular flow passage 137. In the illustrated embodiment, guide assembly 113 includes a guide vane type pump 43 mounted to cooling chamber shaft 123 within pump chamber 141. The pitch of pump 143 is selected base on the fluid viscosity and the resonance time necessary to maximize the heat transfer from the circulating fluid to heat exchange housing 117 within fluid reservoir 121.

Heat exchange housing 117 includes a plurality of fins 145 formed on an exterior diameter portion of heat exchange housing 117. Fins 145 run the length of heat exchange housing 117 and conduct heat from fluid reservoir 121 through a wall of heat exchange housing 117 into the environment surrounding cooling chamber assembly 109. In the illustrated embodiment, fins 145 are of a number, size, and shape such that fins 145 double the exterior surface area of heat exchange housing 117 over a heat exchange housing 117 without fins 145 without increasing the exterior diameter of the assembly. A person skilled in the art will understand that the number, size, and shape of fins 145 may be varied to accommodate the particular application of cooling chamber assembly 109.

A thrust bearing 139 will couple to an end of cooling chamber assembly 109 proximate to pump assembly 113. Thrust bearing 139 includes a thrust runner 147, up thrust bearings 149, and primary thrust bearings 151. Thrust runner 147 mounts to cooling chamber shaft 123 such that as cooling chamber shaft 123 rotates, thrust runner 147 will rotate within a thrust housing 153 coupling pump housing 135 to a thrust bearing head 155. Thrust bearing head 155 includes an end adapted to receive and allow coupling of a rotating shaft from a subsequent assembly, such as a another thrust bearing assembly or a sealing chamber assembly. Thrust runner 147 has an exterior diameter slightly smaller than the inner diameter of thrust housing 153, such that fluid may flow past thrust runner 147 between the exterior diameter surfaces of thrust runner 147 and the interior diameter surface of thrust housing 153. During operation, thrust generated by an electric submersible pump (not shown) will force thrust runner 147 against primary bearings 151 as cooling chamber shaft 123 rotates. Fluid circulated by pump 143 will wedge between the interfacing surfaces of thrust runner 147 and primary bearings 151, lubricating the bearing surfaces and absorbing the heat generated by the frictional forces between thrust runner 147 and primary bearings 151. The embodiment of FIG. 7 does not intend a seal section such as seal chamber assembly 15 of FIG. 3A.

In operation of cooling chamber assembly 109, cooling chamber shaft 123 rotates in response to rotation of an ESP pump motor (not shown). Rotation of cooling chamber shaft 123 causes pump 143 to rotate. As pump 143 rotates it will draw fluid from fluid passageway 125 through pump chamber 141 and then through thrust bearing assembly 139 along a pathway similar to that illustrated in FIG. 5. Referring to FIG. 7, fluid within thrust bearing assembly 139 will be forced through flow passage 137 into fluid reservoir 121, and fluid within fluid reservoir 121 will circulate across filters 129 through openings 127 into flow passage 125. As fluid flows through thrust bearing assembly 139, heat generated through operation of thrust bearing assembly 139 will transfer into the fluid, thereby heating the fluid. This fluid will then flow into fluid reservoir 121 where the heat will transfer from the fluid into heat exchange housing 117. The heat is then conducted by heat exchange housing 117 through fins 145 and into the ambient environment.

Figure 8:
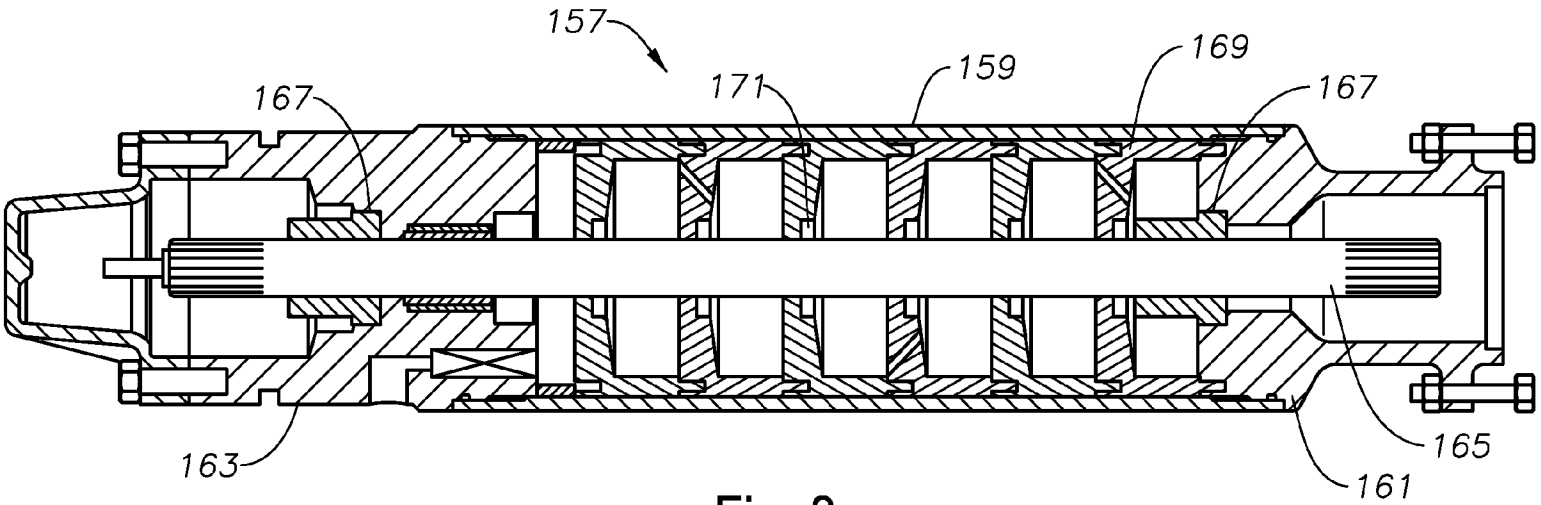
FIG. 8 is a sealing assembly in accordance with an embodiment of the present invention.

Other embodiments of the present invention may include only sealing chamber assembly 15 and not a cooling chamber 17. As illustrated in FIG. 8, a sealing chamber assembly 157 includes a chamber housing 159. Chamber housing 159 includes first and second ends 161, 163 adapted to couple sealing chamber assembly 157 to an external device such as an electric motor, another sealing chamber assembly 157, a thrust bearing module 11, a thrust bearing, or the like. In the illustrated embodiment, first end 161 is adapted to insert into an end module of a subsequent device, and second end 163 is adapted to receive an end module of a subsequent device. A sealing chamber shaft 165 is supported within sealing chamber assembly 157 at first end 161 and second end 163. Sealing chamber shaft 165 may rotate and may have splined ends for coupling to additional rotating shafts such that rotation of shaft 165 will cause rotation of the additional shafts and vice versa. Rotational shaft seals 167 will support sealing chamber shaft 165 within ends 161, 163. Rotational shaft seals 167 allow shaft 165 to rotate within sealing chamber assembly 159, while preventing wellbore fluids from passing along shaft 165 to the subsequent pump element, such as the electric motor.

Sealing chamber assembly 157 can include a plurality of labyrinth discs 169. Each labyrinth disc 169 mounts within sealing chamber housing 159 and seals to sealing chamber housing 159 and sealing chamber shaft 165. Labyrinth discs 169 seal to sealing chamber shaft 165 with lip seals 171. Each labyrinth disc 169 includes the components of and operates as labyrinth discs 61 of FIGS. 3A-3I.

Accordingly, the disclosed embodiments provide numerous advantages. For example, the disclosed embodiments provide a thrust module for an ESP with improved lubrication of the thrust bearing. In addition, the disclosed embodiments provide a thrust module that increases the rate of heat transfer from the thrust bearing to the surrounding environment while also filtering particles from the lubricating fluid. This is accomplished by a finned cooling chamber housing that is maintained within the primary outer diameter of the thrust module assembly. This decreases the wear on the thrust bearing and increases the longevity of the thrust bearing by decreasing the rate of break down of the lubricating fluid. In addition, the disclosed embodiments provide an improved sealing chamber assembly that provides additional redundancy to reduce the likelihood that wellbore fluid will migrate into the thrust module and ultimately the electric motor providing mechanical energy to the thrust module. Furthermore, the labyrinth sealing assembly decreases the rate of migration of assembly fluid into the surrounding wellbore. This will decrease the amount of any maintenance needed for the thrust bearing and the electric motor, while also increasing the useful life of the ESP.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A submersible pump assembly comprising:

a rotary primary pump;

a motor;

a shaft assembly extending from the motor into the primary pump along an axis for driving the primary pump;

a thrust bearing in a thrust bearing housing between the motor and the primary pump that absorbs thrust from the primary pump, the shaft assembly extending through the thrust bearing housing, the thrust bearing having a thrust runner mounted to the shaft assembly for rotation therewith, the thrust runner being in sliding engagement with the thrust bearing;

a circulation pump having vanes and mounted to the shaft assembly for rotation therewith in the thrust bearing housing at a position axially spaced from the thrust runner, the circulation pump being in fluid communication with lubricant contained in the thrust bearing housing to circulate the lubricant along a flow path through the thrust bearing;

a sleeve within the thrust bearing housing surrounding the shaft assembly, defining an inner annulus between the sleeve and the shaft assembly and an outer annulus between the sleeve and the thrust bearing housing;

an aperture in a side wall of the sleeve adjacent one end of the sleeve, placing the inner annulus and the outer annulus in fluid communication with each other and defining the flow path for the lubricant;

wherein the circulation pump is located in the inner annulus; and a plurality of fins formed on an exterior portion of the thrust bearing housing to dissipate heat generated in the thrust bearing.

2. The submersible pump assembly of claim 1, further comprising a pressure equalizer mounted on an end of the motor opposite the thrust bearing housing.

3. The submersible pump assembly of claim 1, further comprising:

a filter element in the flow path to remove particles from the lubricant.

4. The submersible pump assembly of claim 1, further comprising a seal assembly operatively connected between the thrust bearing housing and the pump, the seal assembly comprising:

a sealing chamber housing through which the shaft assembly extends;

a plurality of labyrinth discs, each having an inner diameter mounted in sealing engagement with but non-rotating engagement with the shaft assembly, each labyrinth disc having a periphery that seals to the sealing chamber housing, the labyrinth discs being axially spaced apart, thereby dividing the sealing chamber housing into labyrinth chambers between each labyrinth disc, each of the labyrinth discs having a first side and a second side normal to the axis and facing axially in opposite directions;

a port extending through each of the labyrinth discs from the first side to the second side; and wherein the ports of adjacent ones of the labyrinth discs are located at different angular positions relative to the axis and at different elevations relative to each other when the pump assembly is horizontally oriented to provide a tortuous fluid flow path for well fluid through the labyrinth discs.

5. The submersible pump assembly of claim 4, wherein each labyrinth disc has a concave profile on one of the first and second sides.

6. The submersible pump assembly of claim 4, wherein each labyrinth disc has a convex profile on one of the first and second sides.

7. The submersible pump assembly of claim 4, wherein the labyrinth chambers are in fluid communication with the lubricant in the thrust bearing housing.

8. The submersible pump assembly of claim 7, wherein the port of each labyrinth disc includes at least two right angle turns.

9. The submersible pump assembly of claim 7, wherein the lubricant in the thrust bearing housing is in fluid communication with lubricant in the motor.

10. The submersible pump assembly of claim 4, further comprising:

a shaft seal around the shaft assembly at a connection between the sealing chamber housing and the thrust bearing housing.

11. A submersible pump assembly comprising:

a rotary primary pump;

a motor operationally coupled to the primary pump for driving the pump;

a thrust bearing in a thrust bearing chamber between the motor and the primary pump;

a rotating shaft passing along a longitudinal axis through a center of the thrust bearing chamber and rotated in response to operation of the motor;

a thrust runner mounted to the shaft for rotation in unison, the thrust runner transferring thrust from the primary pump to the thrust bearing;

a sealing chamber housing operatively coupled between the thrust bearing chamber and the primary pump;

the rotating shaft extending through the sealing chamber housing;

a plurality of labyrinth discs mounted in sealing engagement with but non-rotating engagement with the rotating shaft, each labyrinth disc having a cylindrical outer wall with a greater axial dimension than a maximum axial thickness of a central portion of each of the labyrinth discs, each of the outer walls extending axially in first and second directions from the central portion of each of the labyrinth discs and having at least one end in abutment with an end of the cylindrical wall of an adjacent one of the labyrinth discs, the outer wall of each of the labyrinth discs having an outer diameter that seals to an inner diameter of the sealing chamber housing, the abutment of the ends of the outer walls of adjacent ones of the labyrinth discs causing the central portions of the labyrinth discs to be spaced apart from each other along the axis of the shaft, thereby dividing the sealing chamber housing into labyrinth chambers between the central portions of adjacent ones of the labyrinth discs, the central portion of each of the labyrinth discs having a first side facing axially in a first direction and a second side facing axially in the second direction;

the central portion of each of the labyrinth discs further containing a port extending from the first side to the second side, causing the labyrinth chambers to be in fluid communication with each other; wherein the ports of adjacent ones of the labyrinth discs are located at different angular positions relative to the axis to provide a tortuous fluid flow path for well fluid through the labyrinth discs when the pump assembly is operated in a horizontal position; and wherein the labyrinth chambers are in fluid communication with lubricant contained in the thrust bearing chamber.

12. The submersible pump assembly of claim 11, further comprising a pressure equalizer mounted to an end of the motor opposite the thrust bearing chamber.

13. The submersible pump assembly of claim 11, wherein:

the outer diameter of each of the outer walls has a maximum that is less than a minimum of the inner diameter of the sealing chamber housing.

14. A submersible pump assembly comprising:

a rotary primary pump;

a motor operationally coupled to the primary pump for driving the pump;

a sealing chamber housing coupled between the motor and the primary pump;

a sealing chamber rotating shaft supported along a longitudinal axis within the sealing chamber housing and driven by the motor;

a plurality of labyrinth discs, each having a central portion and mounted in sealing engagement with but non-rotating engagement with the sealing chamber rotating shaft, each labyrinth disc having an outer wall surrounding the central portion that seals to the sealing chamber housing, the outer wall of each of the labyrinth discs having a greater axial dimension than the central portion of each of the labyrinth discs, the outer wall of at least one of the labyrinth discs having ends in abutment with ends of the outer walls of adjacent ones of the labyrinth discs, the central portion of said at least one of the labyrinth discs being spaced axially from the central portions of the adjacent ones of the labyrinth discs, thereby dividing the sealing chamber housing into labyrinth chambers between the central portions of said at least one of the labyrinth discs and the adjacent ones of the labyrinth discs, the central portion of each of the labyrinth discs having a first side facing axially in one direction and a second side facing axially in an opposite direction;

each of the labyrinth discs further containing a port extending from the first side to the second side of each of the labyrinth discs, causing the labyrinth chambers to be in fluid communication with each other; and wherein the ports of adjacent ones of the labyrinth discs are located at different angular positions relative to the axis to provide a tortuous fluid flow path for well fluid through the labyrinth discs when the pump assembly is operated in a horizontal position.

15. The submersible pump assembly of claim 14, further comprising first and second connectors secured to opposite ends of the sealing chamber; and wherein the outer wall of a first one of the labyrinth discs engages the first connector and spaces the central portion of the first one of the labyrinth discs axially from the first connector; and the outer wall of a second one of the labyrinth discs engages the second connector and spaces the central portion of the second one of the labyrinth discs axially from the second connector.

16. The submersible pump assembly of claim 14, wherein one of the first and second sides of each labyrinth disc has a concave profile.

17. The submersible pump assembly of claim 14, wherein one of the first and second sides of each labyrinth disc has a convex profile.

18. The submersible pump assembly of claim 14, wherein the port of each labyrinth disc includes at least two right angle turns.

19. The submersible pump assembly of claim 14, wherein when the pump assembly is operated in the horizontal position, the ports of adjacent ones of the labyrinth discs are at different elevations relative to each other.

* * * * *

UNITED STATES PATENT AND TRADEMARK OFFICE

CERTIFICATE OF CORRECTION

PATENT NO. : 8,845,308 B2
APPLICATION NO. : 13/086503
DATED : September 30, 2014
INVENTOR(S) : Steven K. Tetzlaff et al.

It is certified that error appears in the above-identified patent and that said Letters Patent is hereby corrected as shown below:

In the Specification

Column 1, line 33, delete “cause” and insert --causes--
Column 9, line 20, insert --art-- between “the” and “will”
Column 10, line 21, delete “base” and insert --based--

Signed and Sealed this
Sixteenth Day of June, 2015

Michelle K. Lee

Michelle K. Lee
*Director of the United States Patent and Trademark Office*